US006972502B2

(12) United States Patent
Marioni

(10) Patent No.: US 6,972,502 B2
(45) Date of Patent: Dec. 6, 2005

(54) DEVICE FOR TRANSMITTING MOTION BETWEEN THE ROTOR OF A SYNCHRONOUS PERMANENT-MAGNET MOTOR AND A WORKING PART

(75) Inventor: Elio Marioni, Dueville (IT)

(73) Assignee: Askoll Holding S.r.l., (IT)

( * ) Notice: Subject to any disclaimer, the term of this patent is extended or adjusted under 35 U.S.C. 154(b) by 0 days.

(21) Appl. No.: 10/931,898

(22) Filed: Sep. 1, 2004

(65) Prior Publication Data

US 2005/0023911 A1 Feb. 3, 2005

Related U.S. Application Data

(63) Continuation of application No. 10/282,603, filed on Oct. 29, 2002, now abandoned.

(30) Foreign Application Priority Data

Oct. 30, 2001 (IT) ..... PD01A0256

(51) Int. Cl.[7] ..... H02K 7/10; F16D 3/02; F16D 3/10

(52) U.S. Cl. ..... 310/75 R; 310/80; 464/73

(58) Field of Search ..... 310/84, 75 R, 310/75 D, 79–80, 92, 96, 100; 464/73; 403/1

(56) References Cited

U.S. PATENT DOCUMENTS

| | | | |
|---|---|---|---|
| 4,557,703 | A | 12/1985 | Rivin |
| 4,750,872 | A | 6/1988 | Palliser |
| 4,861,240 | A | 8/1989 | Marioni et al. |
| 5,668,425 | A | 9/1997 | Marioni et al. |
| 6,384,508 | B1 | 5/2002 | Marioni |

FOREIGN PATENT DOCUMENTS

| | | | |
|---|---|---|---|
| EP | 0 287 984 | A2 | 10/1988 |
| EP | 0 481 410 | A2 | 4/1992 |
| EP | 0 723 329 | A2 | 7/1996 |
| EP | 0 945 622 | A1 | 9/1999 |
| WO | WO-99/48189 | A1 | 9/1999 |

*Primary Examiner*—Burton Mullins
(74) *Attorney, Agent, or Firm*—Akerman Senterfitt

(57) ABSTRACT

An improved device for transmitting motion between the rotor of a synchronous permanent magnet motor and a working part. The device includes a first coupling, provided with a driving element, which is eccentric with respect to the rotation axis of the rotor, at a rotor shaft end. A second coupling cooperates in a kinematic series with the first coupling and is provided with a driven element, that is eccentric with respect to the rotation axis of the rotor and rigidly formed with said working part. The driving and driven elements lie in distinct and non-interfering axial positions. The device further includes two elastic elements, which are set angularly after each other, one of them interfering with the driving element of the first coupling and the other one interfering with the driven element of the second coupling.

27 Claims, 2 Drawing Sheets

DEVICE FOR TRANSMITTING MOTION BETWEEN THE ROTOR OF A SYNCHRONOUS PERMANENT-MAGNET MOTOR AND A WORKING PART

FIELD OF APPLICATION

The present invention relates to an improved device for transmitting motion between the rotor of a synchronous permanent-magnet motor and a working part.

As is known, the construction of an electric motor with a permanent magnet rotor includes a stator, stator core laminations, stator windings, and a rotor placed between at least two stator poles.

A shaft extends longitudinally through the rotor and is mounted rotatably on a bearing structure.

It is also known that the starting phase of a synchronous motor is harder as the inertia of the working part increases.

As a matter of fact, the motor starting phase is a transient mode wherein the direction of rotation, the speed, and the current, are all bound to change before a synchronised mode is reached.

During this transient mode, the rotor is imparted a rocking movement by the stator generating an alternating magnetic field. This rocking movement, by inducing a torque on the permanent magnet rotor, forces the rotor to move into a position where the rotor magnetic field is aligned to the stator field.

Under this "rocking" condition, as the rotor gathers up a sufficient amount of kinetic energy to move just a trifle out of its aligned position, it receives an additional acceleration that forces it to rotate another fraction of a turn. These effects cumulate until the synchronised mode is reached.

PRIOR ART

Actually, a wide use is made of mechanical couplings for connecting the rotor to the working part; at the starting phase these couplings allow the rotor to freely rock through a predetermined angle.

Such is the case with the so-called dog couplings, wherein a first engaging tooth, which is eccentric with respect to the rotation axis, is rigidly coupled to the rotor and a second engaged tooth, which is also eccentric with respect to the rotation axis, is rigidly coupled to the working part.

In this manner, during the transient starting phase the rotor is relieved from the inertia of the working part, and this makes achieving the synchronised mode of operation easier.

In other words, a free angular movement (typically of 180 degrees) of idle rotation is allowed, at the end of which the load is engaged with a shock, locking the rotor and the working part to rotate together. In actual operation, a positive type of motion transmission is thus established.

Thus, the idle rotation transient enables the motor to reach the synchronised mode of operation and to develop a sufficient amount of torque to overcome the inertia of the working part on starting.

A device for transmitting motion between the rotor of a synchronous permanent magnet motor and a working part is disclosed in European Patent Application No. 99910348.4 in the name of this Applicant. This device comprises at least two motion transmission couplings which mutually cooperate in a kinematic series.

A first coupling of said device comprises at least one driving element which is eccentric with respect to the rotation axis and is rigidly coupled to the rotor and at least one driven element which is also eccentric with respect to the rotation axis and can rotate freely with respect to said rotor.

A second coupling of said device comprises at least one driving element which is eccentric with respect to the rotation axis and one driven element which is also eccentric with respect to the rotation axis and is rigidly coupled to the working part.

The angle covered by the elements of each coupling is, as a whole, less than a round angle, but the driving element of the second coupling correspond to the driven element of said first coupling, so that the angle of freedom between the rotor and the working part is increased.

In other words, the driving member of the first coupling and the driven member of the second coupling are placed at discrete axial locations clear of each other, and the intermediate component working as driven member of the first coupling and driving member of the second coupling interferes with its axial outline in the paths of motion of both members.

This intermediate component placed between the driving and driven members of the first and second coupling is a single elastic element made of rubber.

A problem faced by this kind of driving couplings is that the very high acceleration rates (on the order of 16,000 rad/sec$^2$) of the rotor cause a shock between the driving and driven members to propagate through the intermediate elastic element.

The resulting shock wave is trapped within the intermediate elastic element, causing the latter to fail prematurely.

A principal object of this invention is to provide an improved device for transmitting motion between the rotor of a synchronous permanent-magnet motor and a working part having structural and functional features obviating the prior art shortcoming above mentioned.

Another object of the invention is to improve the acoustic efficiency (quiet running feature) of the device from the motor starting phase to the steady state for the whole life of the motor.

A further object of the invention is to provide a motion transmission device of simple construction and compact size.

Still another object of the invention is to provide a motion transmission device of relatively low cost.

Not least an object of the invention is to enhance the fatigue resistance of the component and its application.

SUMMARY OF THE INVENTION

These and other objects are reached by an improved device for transmitting motion between the rotor of a synchronous permanent-magnet motor and a working part associated to said rotor, comprising:

- a first coupling, provided with a driving element, which is eccentric with respect to the rotation axis of the rotor, at a rotor shaft end,
- a second coupling, which cooperates in a kinematic series with said first coupling and is provided with a driven element, that is eccentric with respect to the rotation axis of the rotor and rigid with said working part, said driving and driven elements lying in distinct and non-interfering axial positions, said driven element of the first coupling and said driving element of the second coupling comprising two elastic elements, which are set angularly after each other, one of them interfering with the driving element of the first coupling and the other one interfering with the driven element of the second coupling.

Further features and advantages of the invention should be more clearly understood from a detailed description of an embodiment thereof, given by way of non-limiting example with reference to the accompanying drawings, in which:

DETAILED DESCRIPTION

Figure 1:
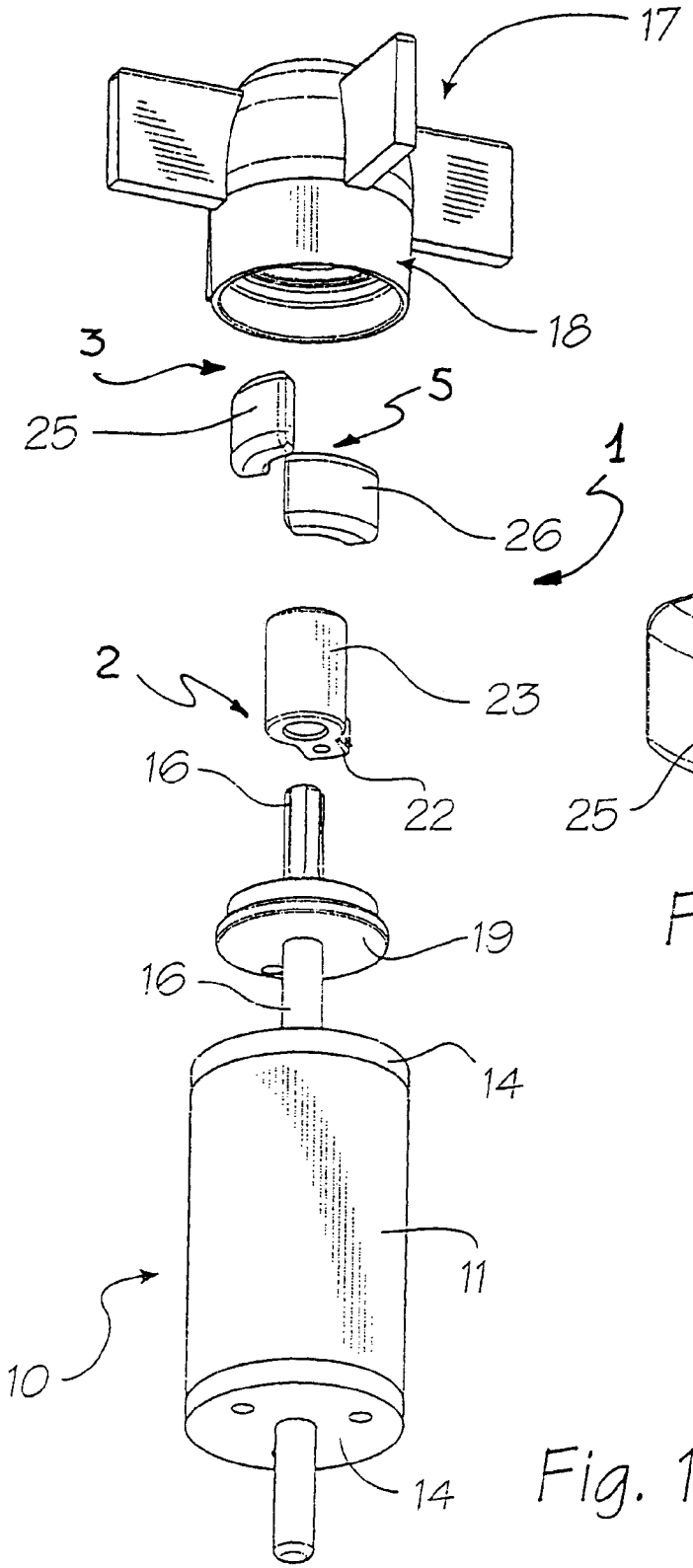
FIG. 1 is an exploded view of a rotor of a permanent magnet electric motor incorporating the device of the present invention.

With reference to the drawing views, the rotor of a synchronous permanent-magnet electric motor is generally shown at 10. The motor is not shown being of a conventional type.

The synchronous motor is suitable for rotating a working part; for instance the motor could be incorporated into a centrifugal pump having as working part an impeller 17. The following description is given with reference to this specific field of application with the only purpose to simplify the overall exposition.

The rotor 10 includes a permanent-magnet 11 having a cylindrical and annular shape mounted as a sleeve on an inner hub 13 of plastic element 12 having an axial passage 15.

The plastics element 12 has oppose flanged ends 14 and is integrally formed with shaft 16 passing through said axial passage 15.

The shaft 16 is coupled to the impeller 17 through a device 1 for transmitting motion realised according to the present invention.

The device 1 comprises at least a first 2 and a second coupling 3 which mutually cooperate in a kinematic series.

The first coupling 2 comprises a driving element 23 comprising a portion 22 which is eccentric with respect to the rotation axis of the rotor 10 and is connected to one end of the shaft 16. Such driving element 23 includes a tooth 22.

The first coupling 2 also comprises a driven element 5, which, in turn, is eccentric with respect to the rotation axis.

This driven element 5 comprises at least a pair of elastic elements 25 and 26 placed in angular succession to each other to occupy a predetermined angular width of about one half of a full turn.

The second coupling 3 comprises a driving element, which is eccentric with respect to the rotation axis of rotor 10 and which is rotatably housed in a hollow body 18, that is described hereinbelow.

Advantageously, the driving element of the second coupling 3 corresponds and is coincident with the driven element 5 of the first coupling 2.

The second coupling 3 also comprises a driven element 24, which is rigid with the working part, i.e. the impeller 17.

This element 24 essentially consists of a tooth, which is eccentric with respect to the rotation axis of rotor 10. Moreover, teeth 22, 24 lie in axial positions, which are distinct and not interfering with one another.

The first and the second couplings are housed in a hollow body 18 provided in the impeller 17 toward the shaft 16 end.

Such a hollow body 18 is sealed by a cover 19, having a central hole 8 crossed by the shaft 16 end and provided with a ring seal 20 located in a seat near the central hole 8.

The driven element 24 of the second coupling 3, which substantially consists of a tooth that has been integrally molded with the impeller, projects inside the hollow body 18.

Element 5, which acts both as driven element of the first coupling 2 and as driving element of the second coupling 3, is rotatably mounted inside the hollow body 18, between the abutting teeth 22, 24.

In practice, teeth 22 and 24 lie on distinct and non-interfering planes transverse to the rotor axis and they are kinematically connected only through element 5, which is in interference with both of them. The angular profile of the teeth 22 and 24 obviously would be low enough for the elastic elements 25 and 26 to enjoy freedom of movement.

Figure 2:
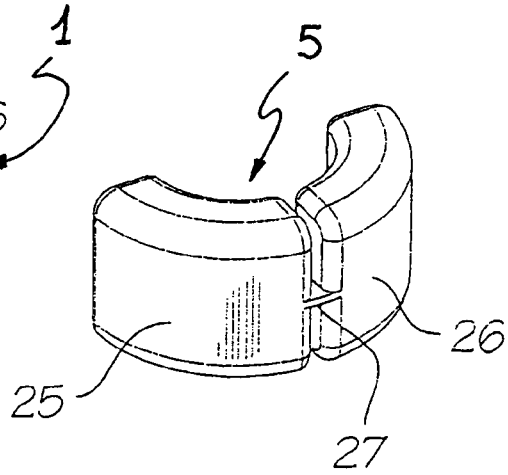
FIG. 2 is a perspective view of an intermediate component of the device of the present invention.
Figure 3:
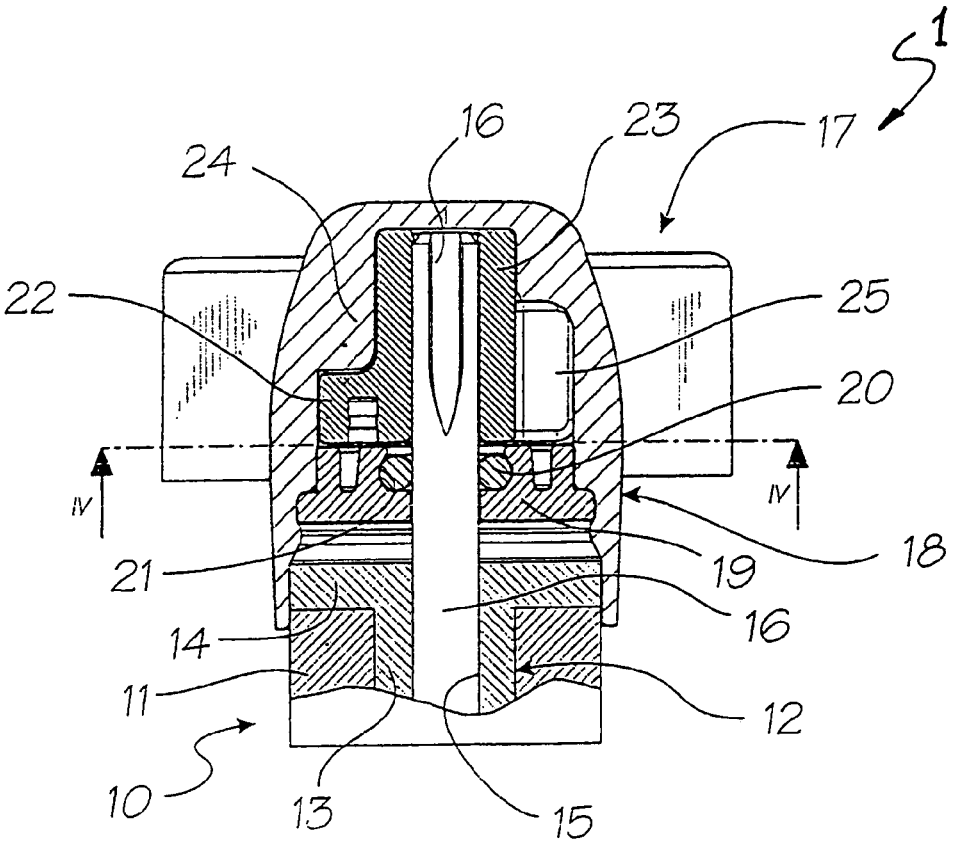
FIG. 3 is a diametrical cross-section view (taken along line III—III in FIG. 4) of the device shown in FIG. 1.
Figure 4:
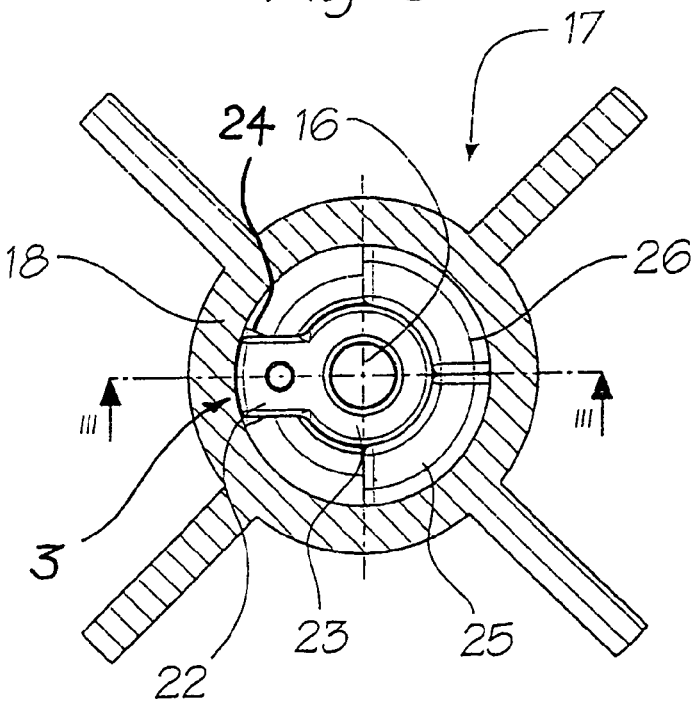
FIG. 4 is a cross-section view taken along line IV—IV in FIG. 3.

Each elastic element, 25 or 26 of element 5 is a ring segment preferably (although not necessarily) spanning one quarter of a full turn. The elements 25, 26 have rounded edges as shown in FIG. 2.

The elements 25, 26 may also have angular widths which are different from one another.

Advantageously, elements 25 and 26 can be made a one-piece construction by means of a diaphragm or bridge 27 located in a middle position. This brings about the advantage that element 5, comprising elements 25, 26, can be individually handled for instance by machines or apparatus of "pick and place" type, suitable for an automatic assembling.

The elements 25 and 26 may be made of the same material (e.g. rubber) or different materials.

The two elements 25 and 26 represent an elastic system, which is capable of progressively dampening the shock between teeth 22 and 24, of which the second, rigid with the impeller 17, is initially still.

Advantageously, elements 25 and 26 spread the shock energy over a larger volume of material than heretofore, at the same time as they deaden the reflected shock wave by the gap provided therebetween.

As a matter of fact, the optional presence of the diaphragm or bridge 27 has no effects the diaphragm is even very likely to break in the long run, but this does not impair in any way the proper working of the motion transmission device 1.

The device according to the invention effectively solves the technical problem and attains several advantages, the first of which lies in that a synchronous motor equipped with the device of the present invention displays a noise, which is definitely lower with respect to the solutions that are presently offered by the state of the art.

Furthermore, a remarkable increase of the working life of such motors has been noted, essentially by virtue of the longer life and the reduced wear of the thus conceived motion transmission device.

Finally, it is worthwhile remarking that the device according to the invention has a simple and reliable structure and a strongly reduced cost. It is also suited for a production on a very large scale, thus reducing the overall manufacture costs and times over automated assembling lines.

What is claimed is:

1. An improved device for transmitting motion between the rotor of a synchronous permanent-magnet motor and a working part associated to said rotor, comprising:

a first coupling, provided with a driving element, which is eccentric with respect to the rotation axis of the rotor at a rotor shaft end, and a driven element which is eccentric with respect to the rotation axis of the rotor; and a second coupling, which cooperates in a kinematic series with said first coupling and is provided with a driving element and a driven element, that is eccentric with respect to the rotation axis of the rotor and rigid with said working part, said driving element of the first coupling and said driven element of the second coupling lying in distinct and non-interfering axial positions, wherein said driven element of the first coupling and said driving element of the second coupling comprise a single elastic member having two elastic elements which are angularly separated from each other with a gap provided therebetween, one of them interfering with the driving element of the first coupling and the other one interfering with the driven element of the second coupling.

2. An improved device according to claim 1, wherein each of said elastic elements has the shape of a ring portion.

3. An improved device according to claim 1, wherein the angular width of one of said elastic elements is different from the angular width of the other one.

4. An improved device according to claim 1, wherein said elastic elements are joined in a one-piece construction by means of a connecting diaphragm or bridge.

5. An improved device according to claim 1, wherein said elastic elements are each made from a different material.

6. An improved device according to claim 1, wherein said elastic member is rotatably mounted in a hollow body provided in said working part, said hollow body being located toward the shaft end and being closed by a cover.

7. An improved device according to claim 2, wherein said ring portion is equal to about 90 degrees.

8. An improved device according to claim 3, wherein the overall angular width which is covered by said elements is equal to about 180 degrees.

9. An improved device according to claim 1, wherein said elastic elements have rounded edges.

10. An improved device for transmitting motion between the rotor of a synchronous permanent-magnet motor and a working part associated to said rotor, comprising:

at least one first and second coupling cooperating in a kinematic series;

the first coupling comprising a driving element, which is eccentric with respect to the rotation axis of the rotor and is rigidly coupled to a rotor shaft end and a driven element which is eccentric with respect to the rotation axis of the rotor;

the second coupling comprising a driving element which is eccentric with respect to the rotation axis of the rotor and a driven element which is integrally formed with said working part;

wherein said driven element of the first coupling corresponds to the driving element of the second coupling and comprises a single elastic member having two elastic elements which are angularly separated from each other with a gap provided therebetween, one of them interfering with the driving element of the first coupling and the other one interfering with the driven element of the second coupling.

11. An improved device according to claim 10, wherein each of said elastic elements has the shape of a ring portion.

12. An improved device according to claim 10, wherein the angular width of one of said elastic elements is different from the angular width of the other one.

13. An improved device according to claim 10, wherein said elastic elements are joined in a one-piece construction by means of a connecting diaphragm or bridge.

14. An improved device according to claim 10, wherein said elastic elements are each made from a different material.

15. An improved device according to claim 10, wherein said elastic member is rotatably mounted in a hollow body provided in said working part, said hollow body being located toward the shaft end and being closed by a cover.

16. An improved device according to claim 11, wherein said ring portion is equal to about 90 degrees.

17. An improved device according to claim 12, wherein the overall angular width which is covered by said elements is equal to about 180 degrees.

18. An improved device according to claim 10, wherein said elastic elements have rounded edges.

19. A synchronous motor including a permanent-magnet rotor and a working part associated to said rotor and comprising:

a device for transmitting motion between the rotor and the working part including:

a first coupling, provided with a driving element, which is eccentric with respect to the rotation axis of the rotor, at a rotor shaft end, and a driven element which is eccentric with respect to the rotation axis of the rotor;

a second coupling cooperating in a kinematic series with said first coupling and provided with a driving element cooperating with said driven element of the first coupling and a driven element that is eccentric with respect to the rotation axis of the rotor and rigidly coupled to said working part, said driving element of the first coupling and said driven element of the second coupling lying in distinct and non-interfering axial positions; and a single elastic member comprising two elastic elements, which are angularly separated from each other with a gap provided therebetween, one of them interfering with the driving element of the first coupling and the other one interfering with the driven element of the second coupling.

20. A synchronous motor according to claim 19, wherein each of said elastic elements has the shape of a ring portion.

21. A synchronous motor according to claim 19, wherein the angular width of one of said elastic elements is different from the angular width of the other one.

22. A synchronous motor according to claim 19, wherein said elastic elements are joined in a one-piece construction by means of a connecting diaphragm or bridge.

23. A synchronous motor according to claim 19, wherein said elastic elements are each made from a different material.

24. A synchronous motor according to claim 19, wherein said elastic member is rotatably mounted in a hollow body provided in said working part, said hollow body being located toward the shaft end and being closed by a cover.

25. A synchronous motor according to claim 20, wherein said ring portion is equal to about 90 degrees.

26. A synchronous motor according to claim 21, wherein the overall angular width which is covered by said elements is equal to about 180 degrees.

27. A synchronous motor according to claim 1, wherein said elastic elements have rounded edges.

* * * * *